US010015580B1

(12) United States Patent
Bruno

(10) Patent No.: US 10,015,580 B1
(45) Date of Patent: Jul. 3, 2018

(54) HEADPHONE ASSEMBLY WITH INTERCHANGEABLE EARPIECE MODULE

(71) Applicant: Joseph R. Bruno, Ballwin, MO (US)

(72) Inventor: Joseph R. Bruno, Ballwin, MO (US)

( * ) Notice: Subject to any disclaimer, the term of this patent is extended or adjusted under 35 U.S.C. 154(b) by 0 days.

(21) Appl. No.: 15/399,288

(22) Filed: Jan. 5, 2017

(51) Int. Cl.
*H04R 1/10* (2006.01)
*H04R 5/033* (2006.01)

(52) U.S. Cl.
CPC ..... *H04R 1/1066* (2013.01); *H04R 5/033* (2013.01); *H04R 1/1008* (2013.01)

(58) Field of Classification Search
CPC ..... H04R 1/10066; H04R 5/033; H04R 1/10; H04R 1/06
USPC ..... 381/379, 378, 370; 181/129
See application file for complete search history.

(56) References Cited

U.S. PATENT DOCUMENTS 4,499,593 A * 2/1985 Antle ..... H04R 1/1066 381/309
5,117,464 A * 5/1992 Jones ..... H04R 1/10 181/129
6,466,681 B1 * 10/2002 Siska, Jr. ..... H04R 5/0335 381/370
9,414,145 B2 * 8/2016 Oishi ..... H04R 1/10
2008/0279409 A1 * 11/2008 Hupkes ..... H04R 1/1066 381/370
2013/0272560 A1 * 10/2013 Dougherty ..... H04R 1/1066 381/378
2015/0281820 A1 * 10/2015 Lamb ..... H04R 1/105 381/381
2016/0007112 A1 * 1/2016 Broadley ..... H04R 1/1066 381/72
2017/0264984 A1 * 9/2017 Pelland ..... H04R 1/06

* cited by examiner

*Primary Examiner* — Albert Kang Wong
(74) *Attorney, Agent, or Firm* — Husch Blackwell LLP

(57) ABSTRACT

The present invention is a headphone assembly comprising a headband for fitting around the head of the user, a first earpiece module detachably connected to the first end of the headband, and a second earpiece module detachably connected to the second end of the headband.

15 Claims, 5 Drawing Sheets

HEADPHONE ASSEMBLY WITH INTERCHANGEABLE EARPIECE MODULE

FIELD OF THE INVENTION

The present invention relates generally to the over-the-head earphones

BACKGROUND OF THE INVENTION

In a conventional headphone assembly, a user wears two earpieces that incorporate a speaker unit. In this case, a headband extends in the left and right directions from the crown of the user's head and connects left and right earpieces. In most headphones, the headband is flexible and comes into contact with the user's head. This headphone is preferably alterable in length or size to ensure proper fit of an earpiece to the head. Often, there is an adjustable mechanism between the headband and the earpieces that provides longitudinal and/or rotational adjustment of the earpieces on the user's head. Adjustable mechanisms may come in various forms, such as hinges, pivots, or flexible sliding pieces.

During use, it is not uncommon for the earpiece or the adjustable mechanism to become damaged. In current systems, the damaged headphone must be discarded because there is no way to replace the damaged component.

Another problem with headphones is that they are sold as an integral unit, such that user has no ability to customize the individual components within the headphone assembly.

Accordingly, there is a need for an improved headphone assembly that allows the user to interchange the earpiece module when it has been damaged. Furthermore, there is a need for a headphone assembly that permits the user to customize the individual earpiece modules to suit his or her aesthetic preferences and fit his or her head.

SUMMARY OF THE INVENTION

The present invention is a headphone assembly comprising a headband, a first earpiece module, and a second earpiece module. The headband fits around the head of the user. The headband has a first end and a second end. The headband includes at least one cable extending between the first end and the second end. The first earpiece module is detachably connected to the first end of the headband. The first earpiece module includes a first earpiece and a first connector. The first connector permits the first earpiece module to be detached from and reattached to the headband. The second earpiece module is detachably connected to the second end of the headband. The second earpiece module includes a second earpiece and a second connector. The second connector permits the second earpiece module to be detached from and reattached to the headband.

In another aspect, the present invention is a headphone assembly comprising a headband for fitting around the head of the user, a first earpiece module detachably connected to the first end of the headband, and a second earpiece module detachably connected to the second end of the headband.

In a further aspect, the present invention is a customizable headphone assembly comprising a headband, a first earpiece module, and a second earpiece module. The headband fits around the head of the user. The headband has a first end and a second end, and at least one cable extending between the first end and the second end. The first earpiece module is detachably connected to the first end of the headband by at least one releasable fastener. The second earpiece module is detachably connected to the second end of the headband by at least one releasable fastener. The second earpiece module has a different size, shape, and/or color relative to the first earpiece module.

The present invention also includes methods of removing an earpiece module from a headphone assembly and reattaching a different earpiece module to the headphone assembly. The methods may be performed for the purpose of replacing a damaged earpiece module or customizing a headphone assembly. As one example, the present invention is a method of replacing an earpiece module of a headphone assembly comprising (i) disconnecting at least one releasable fastener that mechanically connects the earpiece module to a headband of the headphone assembly, (ii) disconnecting a wire that electrically connects the earpiece module to the headband of the headphone assembly, (iii) removing the earpiece module from the headphone assembly, and (iv) electrically and mechanically coupling a new earpiece module to the headband.

Additional aspects of the invention will be apparent to those of ordinary skill in the art in view of the detailed description of various embodiments, which is made with reference to the drawings, a brief description of which is provided below.

Figure 1:
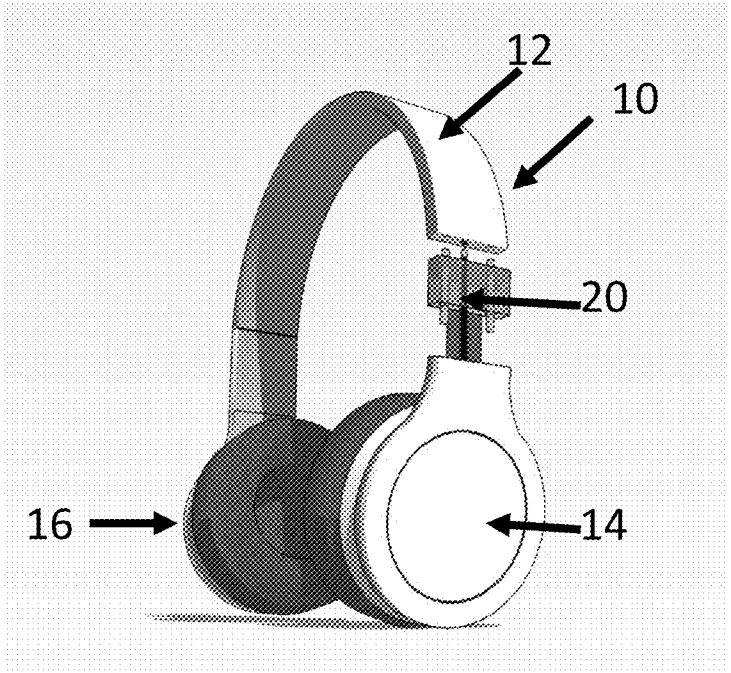
FIG. 1 illustrates a first perspective view of the headphone assembly of the present invention.

While the invention is susceptible to various modifications and alternative forms, specific embodiments will be shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

The drawings will herein be described in detail with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Figure 2:
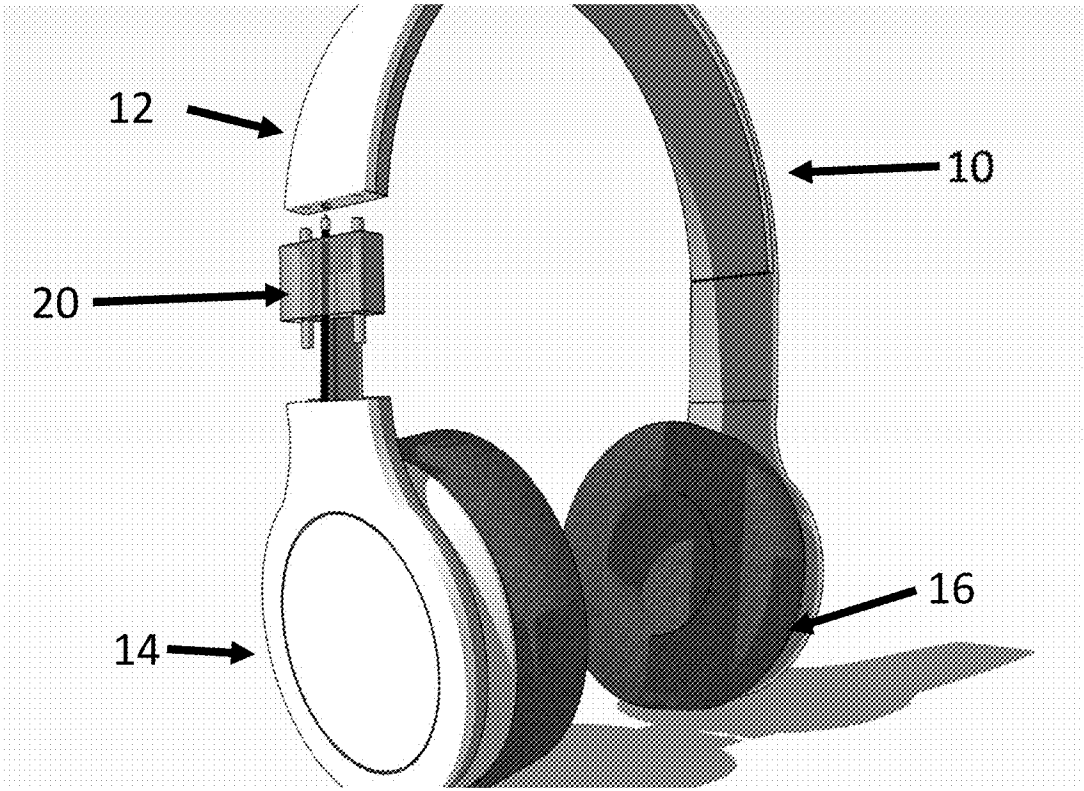
FIG. 2 illustrates a second perspective view of the headphone assembly of the present invention.
Figure 3:
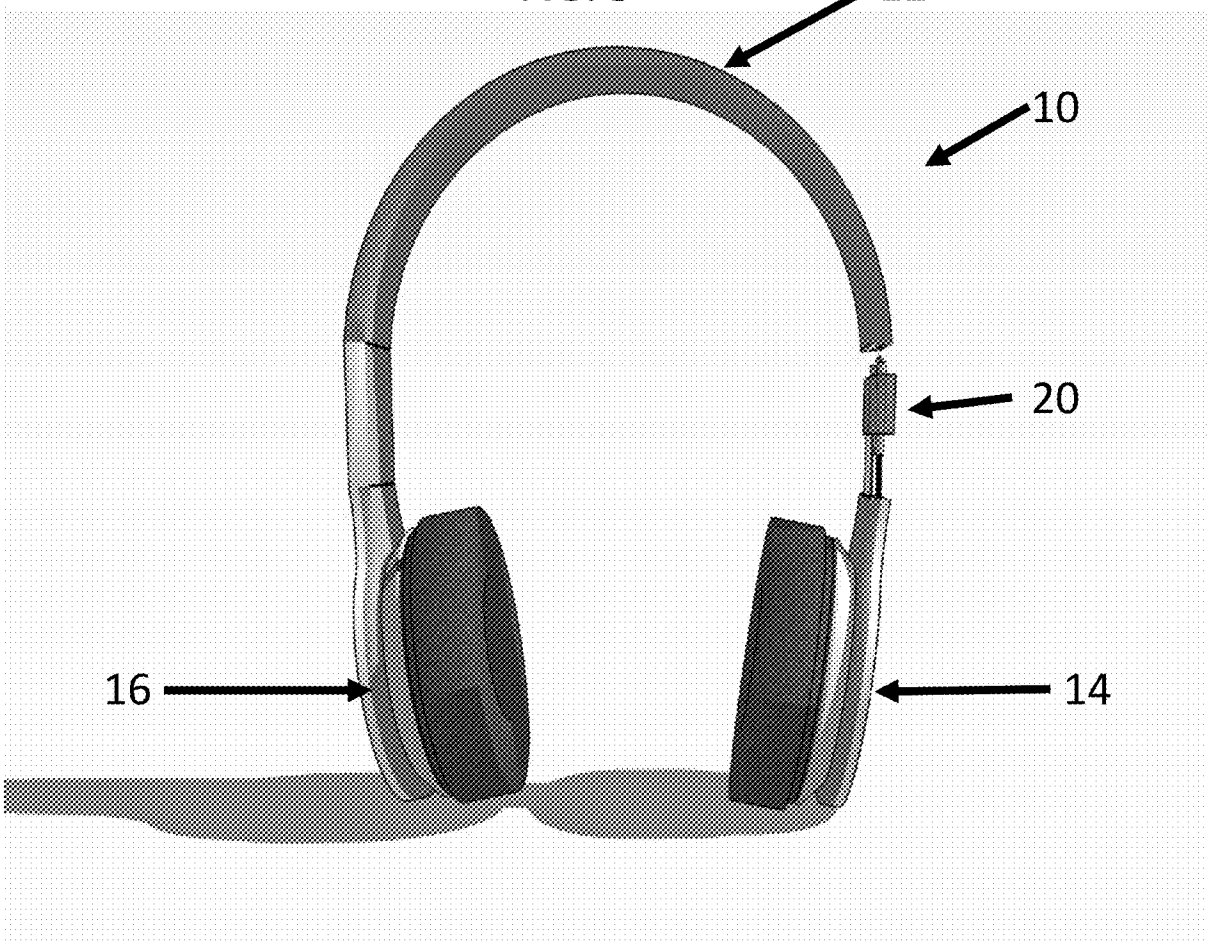
FIG. 3 illustrates a front view of the headphone assembly in FIGS. 1-2

FIGS. 1-3 illustrate a headphone assembly 10 that includes a headband 12 connected to a first earpiece 14 and a second earpiece 16. A connecting structure 20 is located between the headband 12 and each of the earpieces 14, 16. Referring specifically to FIG. 3, the connecting structure 20 in combination with the first earpiece 14 comprises a single module that can be mechanically and electrically connected to the headband 12. Accordingly, in the headphone assembly 10 of the present invention, the first earpiece 14 and the second earpiece 16 can be removed from the headband 12, such that the headphone assembly 10 may be considered to be in three individual subassemblies.

Because the earpieces 14, 16 are required to be electrically coupled, the headband 12 includes internal cables and/or wires (not shown) to provide this functionality. While the headband 12 is required to have some thickness in order to accommodate the cables and/or wires, it is comprised of one or more flexible materials to provide comfort and adjustability to the user when it is placed over the user's head. These materials may include flexible metals, flexible polymers, or combinations thereof.

As is known in common headphones, each earpiece 14, 16 typically comprises a speaker module, a power module (preferably rechargeable), and a circuit module. The speaker module converts the audio signal into an acoustic signal that is directed toward the user's ear. The circuit module may comprise an active noise-cancelling circuitry, a Bluetooth circuitry, and/or a multi-channel audio controller. The power module is adapted for providing the circuit module and the speaker module with the necessary power for operation. Other types of circuitry and components (e.g., user input, user control, communication modules) may be present in the earpieces 14, 16 as well.

Figure 4:
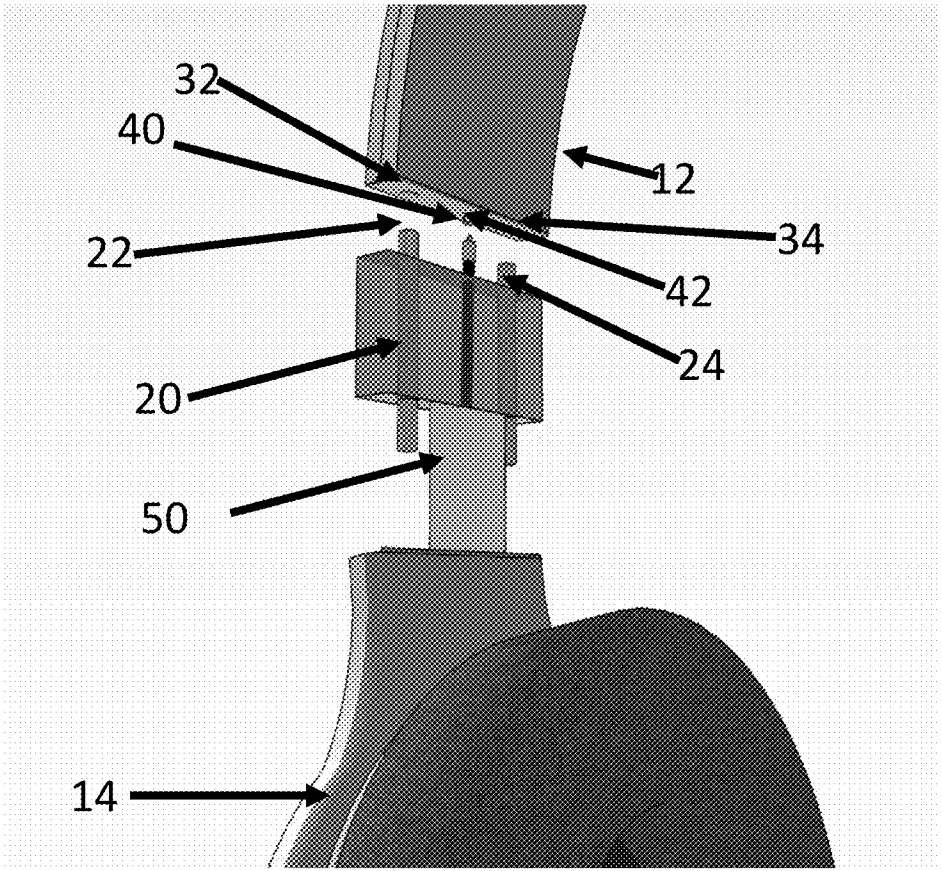
FIG. 4 illustrates an enlarged perspective view of the earpiece section of the headphone assembly of FIGS. 1-2.
Figure 5:
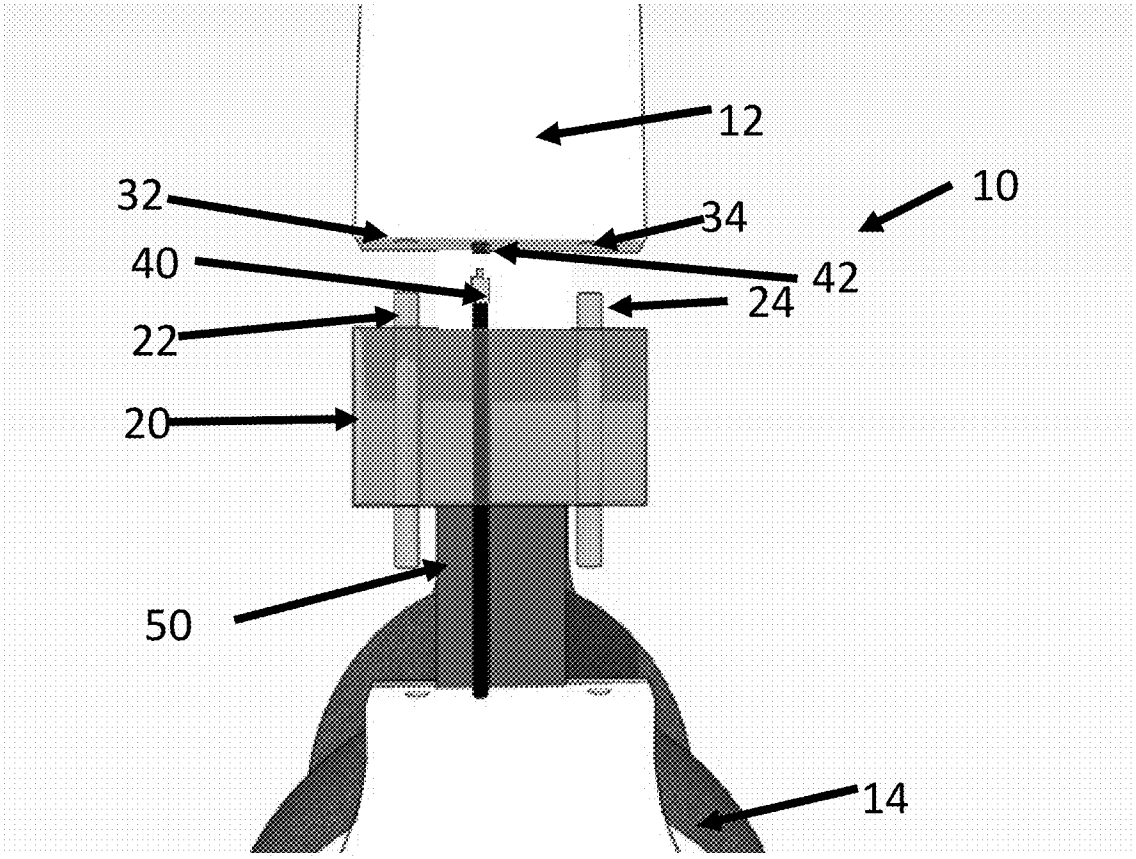
FIG. 5 illustrates an enlarged view of the earpiece section of the headphone assembly.

Referring to FIGS. 4-5, the connecting structure 20 includes a pair of threaded fasteners 22, 24 for engaging a pair of threaded openings 32, 34, respectively, in the headband 12. Accordingly, the threaded fasteners 22, 24 provide the mechanical attachment between the earpiece 14 and the headband 12. Additionally, the connecting structure 20 includes a connecting cable 40 that having a terminal end that fits within and makes electrical contact with an electrical port 42 located within the headband 12. The terminal end of the connecting cable 40 can also be held in a fixed manner relative to the connecting structure 20 and the threaded fasteners 22, 24, such that the screwing of the threaded fasteners 22, 24 into the headband 12 automatically forces the terminal end of the cable 40 into the electrical port 42. The electrical port 42 is coupled to be wires and/or cables within the headband 12. To accommodate the pair of threaded fasteners 22, 24 and the connecting cable 40, the connecting structure 20 includes correspondingly shaped hollow openings extending through the connecting structure 20. Each of the threaded fasteners 22, 24 is preferably held captive within the connecting structure 20 such that they cannot be removed from the connecting structure 20. The heads of the threaded fasteners 22, 24 are exposed on the lower side of the connecting structure 20 that faces the earpiece 14. Once the threaded fasteners 22, 24 are mechanically coupled to the headband 12, the connecting structure 20 remains in a fixed position relative to the headband 12. While the illustrated body has been described relative to the use of threaded fasteners 22, 24, other types of releasable fastening mechanisms can be used as well, such as pins, straps, and/or latches. Also, while FIGS. 4-5 are described relative to the earpiece 14, the stated structure and functionality apply equally to the earpiece 16.

The connecting structure 20 also includes a slide connector 50 that is fixed within the connecting structure 20 and is slidably received by the housing of the earpiece 14. The slide connector 50 permits the user to adjust the earpiece 14 relative to the headband 12 to better accommodate his or her head. The slide connector 50 has one end that is attached to the connecting structure 20. The earpiece 14 is slides up and down along the slide connector 50 thereby permitting a better fit for the user. The slide connector 50 is also flexible so as to provide some rotational or pivotable positioning of the earpiece 14 relative to the headband 12 to better accommodate the shape of the user's head and dynamic movements of the user's head. As shown in FIG. 5, the upper end of the housing of the earpiece 14 may include openings so as to receive the head portions of the threaded fasteners 22, 24. In this way, the head portions of the threaded fasteners 22, 24 also serve to guide the connecting structure 20 onto the earpiece 14 when the earpiece 14 slides along the sliding connector 50.

If the earpiece 14 becomes damaged, the user can remove it in accordance with the following steps. First, the user pulls the earpiece 14 away from the connecting structure 20 to expose the manipulative ends of the threaded fasteners 22, 24. The user then unscrews the threaded fasteners 22 and 24 from the threaded openings 32, 34 in the headband 12 such that the connecting structure 20 can be moved downwardly away from the headband 12. Each of the threaded fasteners 22, 24 may be a simple screw with a head to accommodate a tool (e.g., Phillips screwdriver). Or, they may have a knurled exterior surface such that they can be manipulated with the user's fingers. After the connecting structure 20 is moved downwardly away from the headband 12, the connecting cable 40 can be released from the electrical port 42 located within the headband 12. The earpiece 14 is now mechanically and electrically decoupled from the headband 12 such that it can be replaced if it has become damaged. A new earpiece can be attached to the headband 12 by connecting its associated connecting cable to the electrical port 42, and screwing its threaded fasteners into the threaded openings 32, 34 in the headband 12. The entire process of removing the damaged earpiece and replacing it with a new earpiece is accomplished within a matter of minutes.

Because the present invention provides modularity to the overall headphone assembly 10, it also provides the opportunity for the user to customize his or her own headphone assembly 10 regardless of whether an earpiece has become damaged. For example, the earpieces 14, 16 do not necessarily need to be the same shape or color. Hence, the user can customize the headphone assembly 10 such that the earpiece 14 is red, the headband 12 is white, and the earpiece 16 is blue.

Alternatively, the earpieces 14, 16 can have logos and/or symbols associated with a certain brand. For example, each earpiece 14, 16 can be made in a distinctive color and have the logo of a college or professional sports team. Accordingly, the user's customize headphone assembly 10 may an earpiece 14 that is red in color with a St. Louis Cardinals baseball team logo, while also having an earpiece 16 is blue in color with a St. Louis Blues hockey team logo. Various logos of musical bands, high schools, colleges, and other organizations can be utilized on the earpieces 14, 16 (and headband 12) as well. Additionally, the overall shape of the earpieces 14, 16 can be different in that the housing is molded and/or manufactured into the shape of a face of an animal (or a person) or other object (e.g., faceted jewel). In other words, in a user's headphone assembly 10, the physical shape of the earpiece 14 may be different from the physical shape of the earpiece 16. As long as the same connecting structure 20 is used, the individual earpieces 14 and 16 can be unique in a variety of ways, while still being operably coupled to the headband 12.

In summary, the user may have several earpieces 14, 16 of different colors, shapes, and sizes that can be interchangeably used together with a single headband 12. By providing this customizable functionality to the headphone assembly 10, it is less likely to be stolen because of the uniqueness associated with the user's selection of the earpieces 14, 16 and headbands 12.

The present invention also contemplates the assembly (and de-assembly) process for the headphone assembly 10. The assembly process associated with the headphone assembly 10 may be based on the user's customized purchase of the components over the Internet or other physical retail outlet. In other words, the seller of the headphone assembly 10 is permitted to individually sell the primary components (the headband 12, the earpiece 14, and the earpiece 16) such that, at the point of purchase, the user can begin to customize his or her headphone assembly 10. After the user's customized purchase, the seller may assemble the primary components into the headphone assembly 10 for the user, or provide the user with the primary components so that he or she can easily assemble it. To the extent that the user later damages one of the earpieces 14, 16 and is in need of a new earpiece, or if the user simply wants to add a new unique earpiece to his or her collection, he or she can purchase another one of the earpieces over the Internet or at a physical retail outlet. Consequently, the present invention provides for an effective way for the user to mechanically and electrically decouple the earpieces 14, 16 from the headband 12 so as to make them easily replaceable. As such, the present invention is useful in providing a cost-effective way to fix a damaged headphone assembly 10 because only one component needs to be replaced (instead of replacing the entire headphone assembly). The present invention also provides a cost-effective alternative that permits users to customize his or her headphone assembly 10 in a truly unique way.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A headphone assembly, comprising:

a headband for fitting around the head of the user, the headband having a first end and a second end, the headband including at least one cable extending between the first end and the second end;

a first earpiece module detachably connected to the first end of the headband, the first earpiece module including a first earpiece and a first connector, the first connector for permitting the first earpiece module to be detached from and reattached to the headband;

a second earpiece module detachably connected to the second end of the headband, the second earpiece module including a second earpiece and a second connector, the second connector for permitting the second earpiece module to be detached from and reattached to the headband;

wherein the first connector includes a connector structure having a wire for attaching to the cable, the connector structure being located between the first end of the headband and the first earpiece; and wherein the first earpiece module further includes an adjustable mechanism for allowing adjustable positioning of the connector structure relative to the first earpiece.

2. The headphone assembly of claim 1, wherein the connector structure includes at least one threaded fastener, the threaded fastener being operable to provide the detachable connection of the first earpiece module to the first end of the headband.

3. The headphone assembly of claim 2, wherein the at least one threaded fastener remains captured within the connector structure after being unscrewed when the first earpiece module is removed from the headband.

4. The headphone assembly of claim 2, wherein the at least one threaded fastener is a screw with a head that is exposed when the connector structure is moved away from the first earpiece.

5. The headphone assembly of claim 1, wherein the wire has a male terminal end and the first end of headband include a female electrical port coupled to the cable, the male terminal end being insertable into the female electrical port.

6. The headphone assembly of claim 5, wherein the adjustable mechanism is a slide mechanism.

7. The headphone assembly of claim 1, wherein the first earpiece module has a different size, shape, or color relative to the second earpiece module.

8. A method of replacing an earpiece module of a headphone assembly, comprising:

disconnecting at least one releasable fastener that mechanically connects the earpiece module to a headband of the headphone assembly;

disconnecting a wire that electrically connects the earpiece module to the headband of the headphone assembly;

removing the earpiece module from the headphone assembly; and electrically and mechanically coupling a new earpiece module to the headband.

9. The method of claim 8, wherein the decoupling of the at least one releasable fastener occurs before the decoupling of the wire.

10. A headphone assembly, comprising:

a headband for fitting around the head of the user, the headband having a first end and a second end, the headband including at least one cable extending between the first end and the second end;

a first earpiece module detachably connected to the first end of the headband, the first earpiece module including a first earpiece and a first connector, the first connector for permitting the first earpiece module to be detached from and reattached to the headband;

a second earpiece module detachably connected to the second end of the headband, the second earpiece module including a second earpiece and a second connector, the second connector for permitting the second earpiece module to be detached from and reattached to the headband;

wherein the first connector includes a connector structure having a wire for attaching to the cable, the connector structure being located between the first end of the headband and the first earpiece;

wherein the connector structure includes at least one threaded fastener, the threaded fastener being operable to provide the detachable connection of the first earpiece module to the first end of the headband; and wherein the at least one threaded fastener is a screw with a head that is exposed when the connector structure is moved away from the first earpiece.

11. The headphone assembly of claim 10, wherein the at least one threaded fastener remains captured within the connector structure after being unscrewed when the first earpiece module is removed from the headband.

12. The headphone assembly of claim 10, wherein the wire has a male terminal end and the first end of headband include a female electrical port coupled to the cable, the male terminal end being insertable into the female electrical port.

13. The headphone assembly of claim 10, wherein the first earpiece module further includes an adjustable mechanism for allowing adjustable positioning of the connector structure relative to the first earpiece.

14. The headphone assembly of claim 10, wherein the adjustable mechanism is a slide mechanism.

15. The headphone assembly of claim 10, wherein the first earpiece module has a different size, shape, or color relative to the second earpiece module.

* * * * *